US007179127B2

(12) United States Patent
Shiu

(10) Patent No.: US 7,179,127 B2
(45) Date of Patent: Feb. 20, 2007

(54) CONNECTOR MINIMIZED IN CROSS-TALK AND ELECTRICAL INTERFERENCE

(75) Inventor: Guo-Jiun Shiu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,980

(22) Filed: Jun. 27, 2005

(65) Prior Publication Data

US 2006/0141866 A1 Jun. 29, 2006

(30) Foreign Application Priority Data

Dec. 24, 2004 (TW) ..... 93220815 U

(51) Int. Cl.
*H01R 13/648* (2006.01)

(52) U.S. Cl. ..... 439/608; 439/108; 439/941

(58) Field of Classification Search ..... 439/108, 439/608, 941, 101

See application file for complete search history.

(56) References Cited

U.S. PATENT DOCUMENTS 4,824,383 A * 4/1989 Lemke ..... 439/108
5,429,520 A * 7/1995 Morlion et al. ..... 439/108
5,507,655 A * 4/1996 Goerlich ..... 439/108
6,350,134 B1 2/2002 Fogg et al.
6,379,165 B1 * 4/2002 Lee ..... 439/108
6,533,614 B1 * 3/2003 Akama et al. ..... 439/608
6,540,559 B1 4/2003 Kemmick et al.
6,666,696 B1 * 12/2003 Wu ..... 439/108

* cited by examiner

*Primary Examiner*—Gary F. Paumen
(74) *Attorney, Agent, or Firm*—Wei Te Chung

(57) ABSTRACT

An electrical connector (100) including an insulative housing (1) formed with at least a tongue (11); signal terminal pairs (31) loaded in the housing, each of the signal terminal pairs comprising a pair of adjacent signal terminals (310), each of the signal terminals having a contact portion (310*a*) attached on two opposing mating surfaces of each said at least a tongue; a first grounding means (321) having front portions (321*a*) attached on said mating surfaces between adjacent signal terminal pairs; and a second grounding means (322) having front portions (322*a*) embedded in said at least a tongue to insulate signal terminal pairs respectively arranged on the two opposing mating surfaces of said at least a tongue.

11 Claims, 8 Drawing Sheets

CONNECTOR MINIMIZED IN CROSS-TALK AND ELECTRICAL INTERFERENCE

BACKGROUND OF THE INVENTION

1. Field of the Invention

The present invention relates to a high density connector in which electrical elements are arranged in a pattern that minimizes cross-talk and electrical interference within the connector.

2. Description of Related Art

To meet the recent requirements for expanding memory of electronic equipment and to comply with the miniaturization trend of the electronics industry, a high-speed transmission is required. Connectors with a high density of signal terminals and a small profile are increasingly used in computers or peripheral equipment. However, since the signal terminals are compactly arranged to improve signal transmission capabilities, electrical cross-talk inevitably occur between adjacent signal terminals during signal transmission especially for high frequency signal transmission thereby adversely affecting performance of the electronic equipment. Various attempts have been made to reduce electrical cross-talk in such high density electrical connectors.

U.S. Pat. Nos. 6,350,134 and 6,540,559 disclose a common method for reducing electrical cross-talk that is to dispose a ground terminal between two adjacent signal terminal pairs. However, as each of the grounding terminals occupies a space on mating surfaces of tongues equal to that of each signal terminal pair, only half of the space on mating surfaces can be used to mount the signal terminals. That decreases density of the signal terminals on the mating surfaces and thus indirectly increases a whole size of the connector. It does not meet the miniaturization requirement for electrical components.

Therefore, a new high density connector is desired to overcome above-motioned problems.

SUMMARY OF THE INVENTION

An object of the present invention is to provide a high density connector in which electrical elements are arranged in a pattern that minimizes cross-talk and electrical interference within the connector.

Another object of the present invention is to provide a high density connector in which the arrangement of electrical elements make the connector minimized in size.

Accordingly, to achieve the above object, an electrical connector of present invention includes an insulative housing formed with at least a tongue; signal terminal pairs loaded in the housing, each of the signal terminal pairs comprising a pair of adjacent signal terminals, each of the signal terminals having a contact portion attached on two opposing mating surfaces of each said at least a tongue; a first grounding means having front portions attached on said mating surfaces between adjacent signal terminal pairs; and a second grounding means having front portions embedded in said at least a tongue to insulate signal terminal pairs respectively arranged on the two opposing mating surfaces of said at least a tongue.

Other objects, advantages and novel features of the present invention will become more apparent from the following detailed description taken in conjunction with the accompanying drawings.

DETAILED DESCRIPTION OF THE INVENTION

Figure 1:
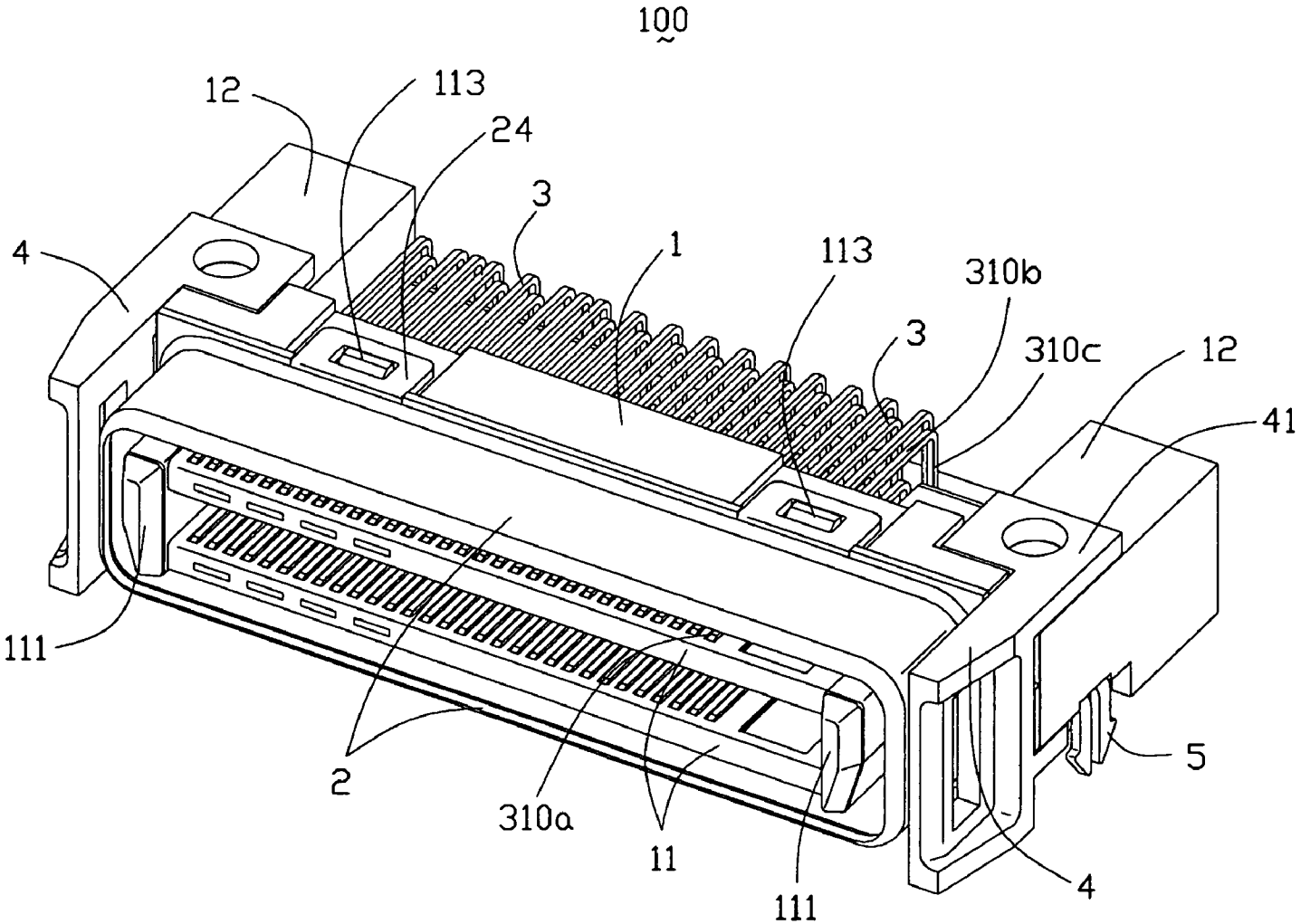
FIG. 1 is an assembled perspective view of a high density connector in accordance with a preferred embodiment of the present invention.

Reference will now be made to the drawing figures to describe the present invention in detail.

Referring to FIG. 1, an electrical connector 100 of the present invention is adapted for mounting onto a Print Circuit Board (PCB) (not shown) and serves as a docking of the PCB to electrically connect with a cable connector assembly (not shown) which serves as a sailer of a periphery equipments.

Figure 3:
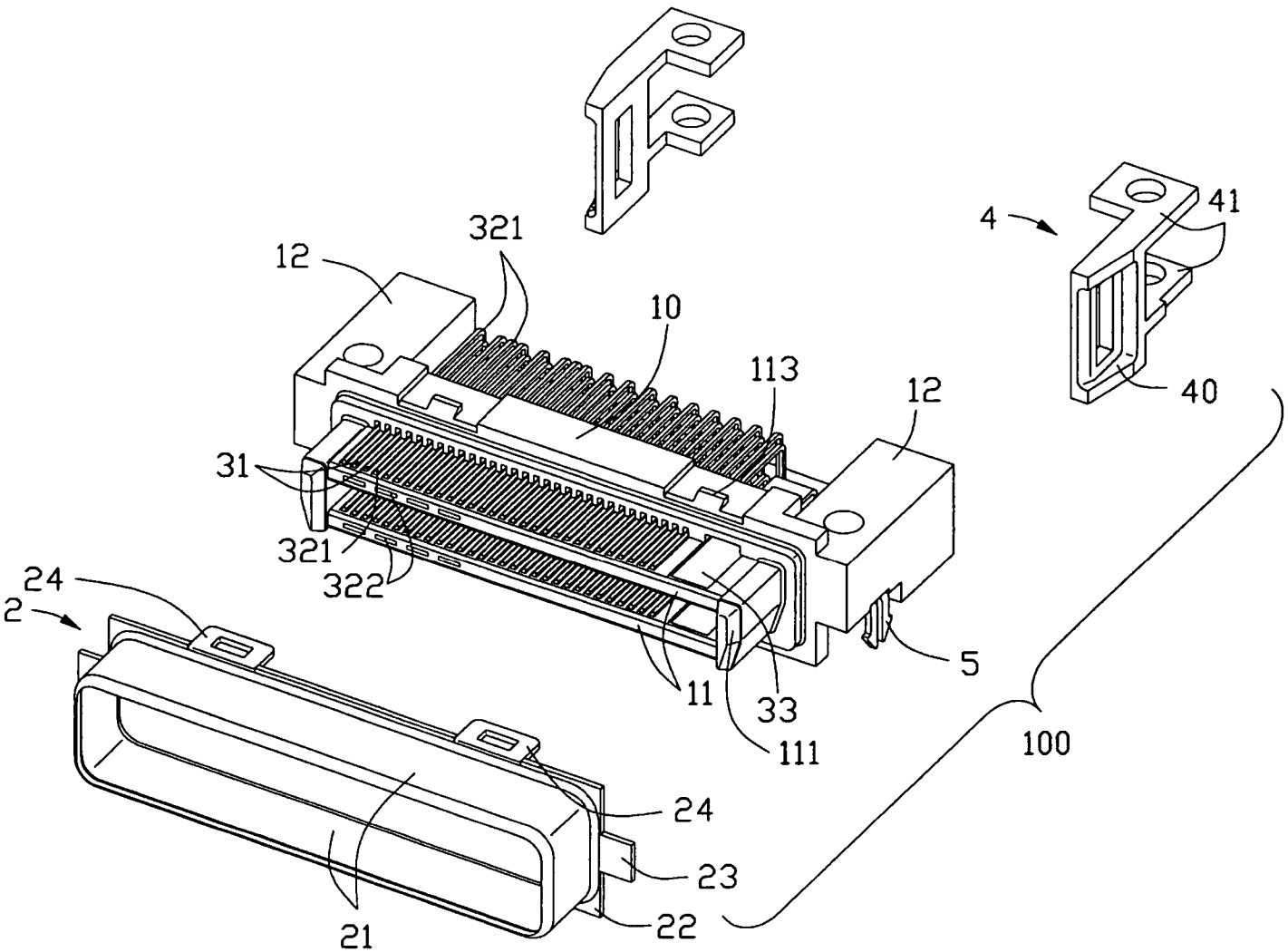
FIG. 3 is an exploded perspective view of the connector of FIG. 1.

As best shown in FIG. 3, the electrical connector 100 comprises a unitarily molded insulative housing 1. The housing 1 includes an elongated intermediated base section 10, a pair of spaced and parallel tongues 11 protruding forwards from a front face of the base section 10, and a pair of mounting blocks 12 extending rearwards from opposite ends of a rear face of base section 10. The two tongues 11 are interconnected at two longitudinal ends thereof by a transverse rib 111 respectively, whereby a frame structure which is much steadier than just a pair of separate said tongues 11 is formed. Each transverse rib 111 is configured with a dissymmetrical cross-section shape, such as taper, for anti-mismating with a complement cable connector assembly, and has a tip extending forwards beyond the tongues 11 for a guiding purpose.

A plurality of electrical elements 3, including signal terminals 310, grounding means 32, and power terminals 33, are arranged in the housing 1 in a pattern that minimizes cross-talk and electrical interference within the connector 100. Wherein each signal terminal 310 is of a right-angled shape comprising a horizontal part and a vertical part 310*c*. Front sections 310*a* of the horizontal parts serve as contact portions attached to four mating surfaces of the pair of tongues 11 and arranged in a row on each one of the mating surfaces for contacting corresponding conductors of the complement cable connector assembly. Contact portions 310*a* in each row are aligned with corresponding contact portions 310*a* in other rows, and thereby the contact portions 310*a* in different rows are arranged in columns along a vertical direction perpendicular to the rows. Rear sections 310*b* of the horizontal parts in conjunction with the vertical parts 310*c* are accommodated in a space between the two opposite mounting blocks 12 of the housing 1, wherein the vertical parts 310*c* serve as solder feet to be soldered to a printed circuit board (PCB). Among the signal terminals 310, some of them will be used to transmit high frequency signals, and the others will be used to transmit signals of ordinary frequencies. With reference to FIG. 1, the signal terminals 310 used to transmit high frequency signals are disposed in pairs (hereafter referred as signal terminal pairs 31) and are arranged in the left of the housing 1 and the signal terminals 310 used to transmit signals of ordinary frequencies are arranged in the right of the housing 1 as in this preferred embodiment of the invention. For these signal terminal pairs 31 used to transmit high frequency signals, the grounding means 32 becomes needed.

Figure 4:
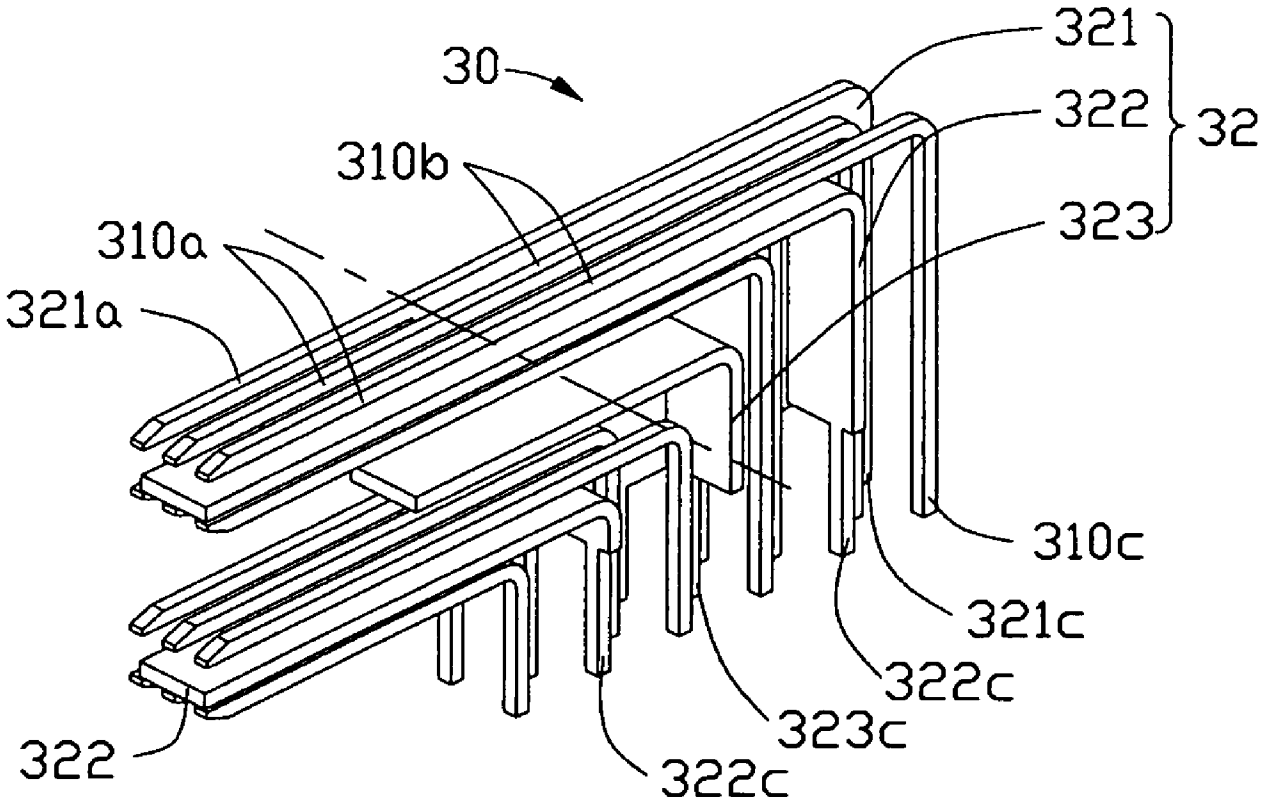
FIG. 4 is a perspective view showing a column of electrical elements including signal terminals and grounding plates of the connector of FIG. 1.
Figure 5:
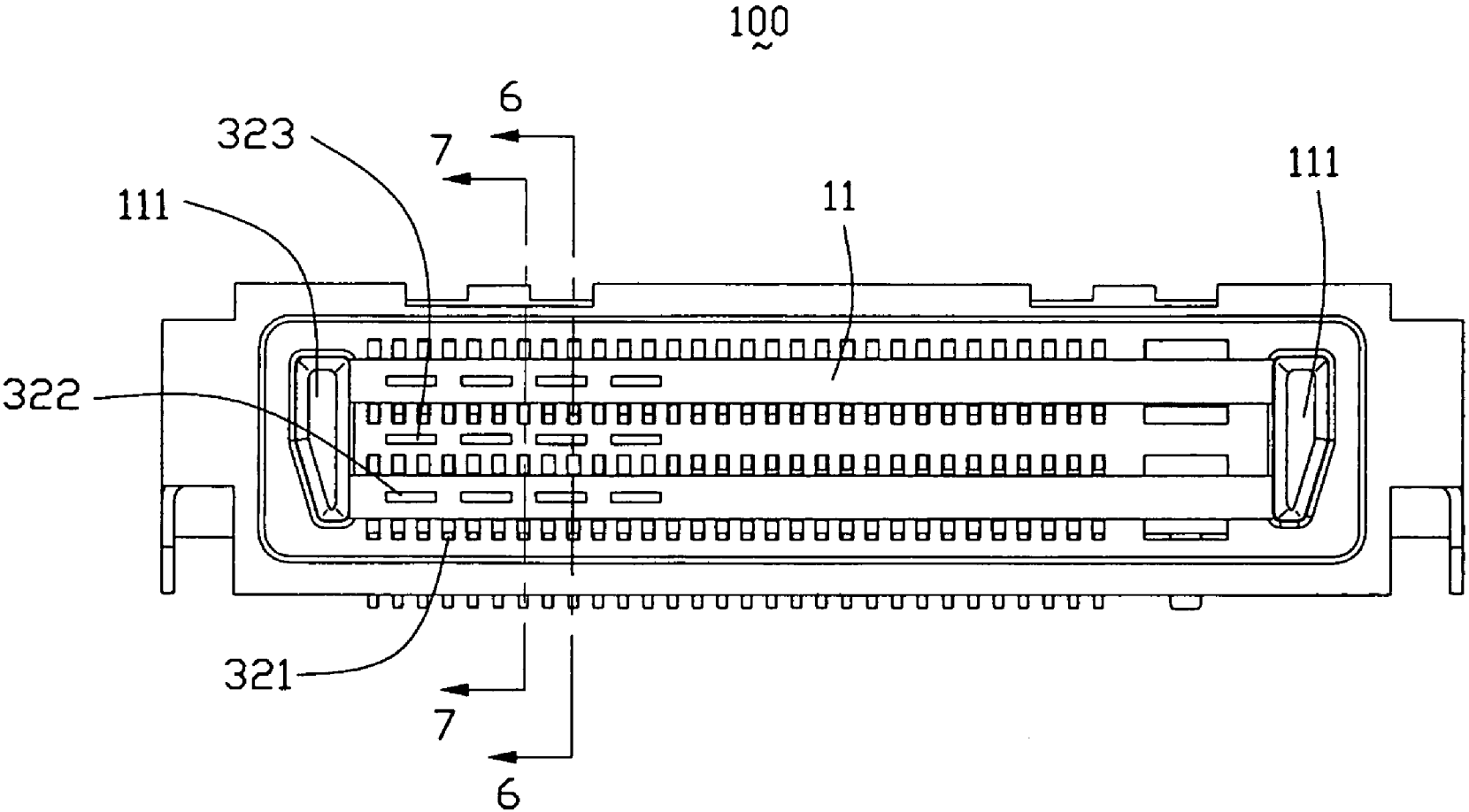
FIG. 5 is a front view of the connector of FIG. 1.
Figure 6:
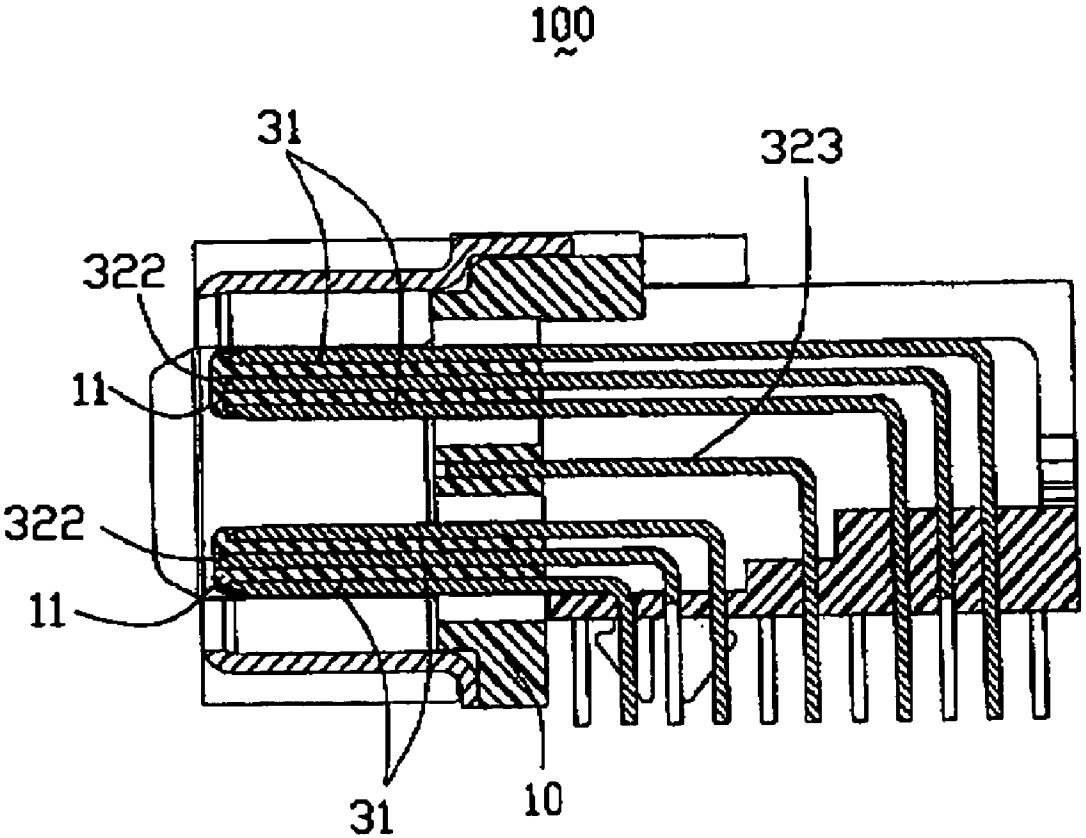
FIG. 6 is a cross-section view taken along 6—6 in FIG. 5.

Detail description of the arrangement between the signal terminal pairs 31 and the grounding means 32 will be given now. FIG. 4 discloses a column of four signal terminal pairs 31 respectively attached to four different mating surfaces of the tongues 11, wherein the upper two signal terminal pairs 31 are respectively attached to two opposite mating surfaces of the upper tongue 11 and the lower two signal terminal pairs 31 are respectively attached to two opposite mating surfaces of the lower tongue 11, as best shown in FIG 6. There is a first grounding plates 321 disposed by one side of the column to insulate it from another adjacent column of the signal terminal pairs 31. Furthermore, there is a pair of second grounding plate 322 respectively disposed between the upper two signal terminal pairs 31 and between the lower two signal terminal pairs 31. Otherwise, in the middle of the column, that is to say in a position between the lower one of the upper two signal terminal pairs 31 and the upper one of the lower two signal terminal pairs 31, is a third grounding plate 323. The grounding plates 322, 323 are both metal strips of a right-angled shape corresponding to the right-angled shape of the signal terminals 310 and having a width substantially equal to the width space along the longitudinal direction of the tongue 11 occupied by each signal terminal pair 31. Such a column of signal terminal pairs 31 in conjunction with the grounding plates 321, 322, 323 constitute a high frequency signal transmission unit 30. These high frequency signal transmission units 30 are arranged one by one in the left of housing 1 for transmitting high frequency signals. As there is a grounding means between every two adjacent signal terminal pairs 31, cross-talk between adjacent signal terminal pairs 31 will be minimized. Otherwise, for those signal terminals 310 used to transmit signals of ordinary frequencies, there is no need for grounding means. So we can just make the signal terminals 310 one by one arranged in the right of the housing 1. Such an arrangement not only meets the requirement to minimize cross-talk within the connector 100 but also meets the requirement to minimize the connector 100 in size.

Figure 7:
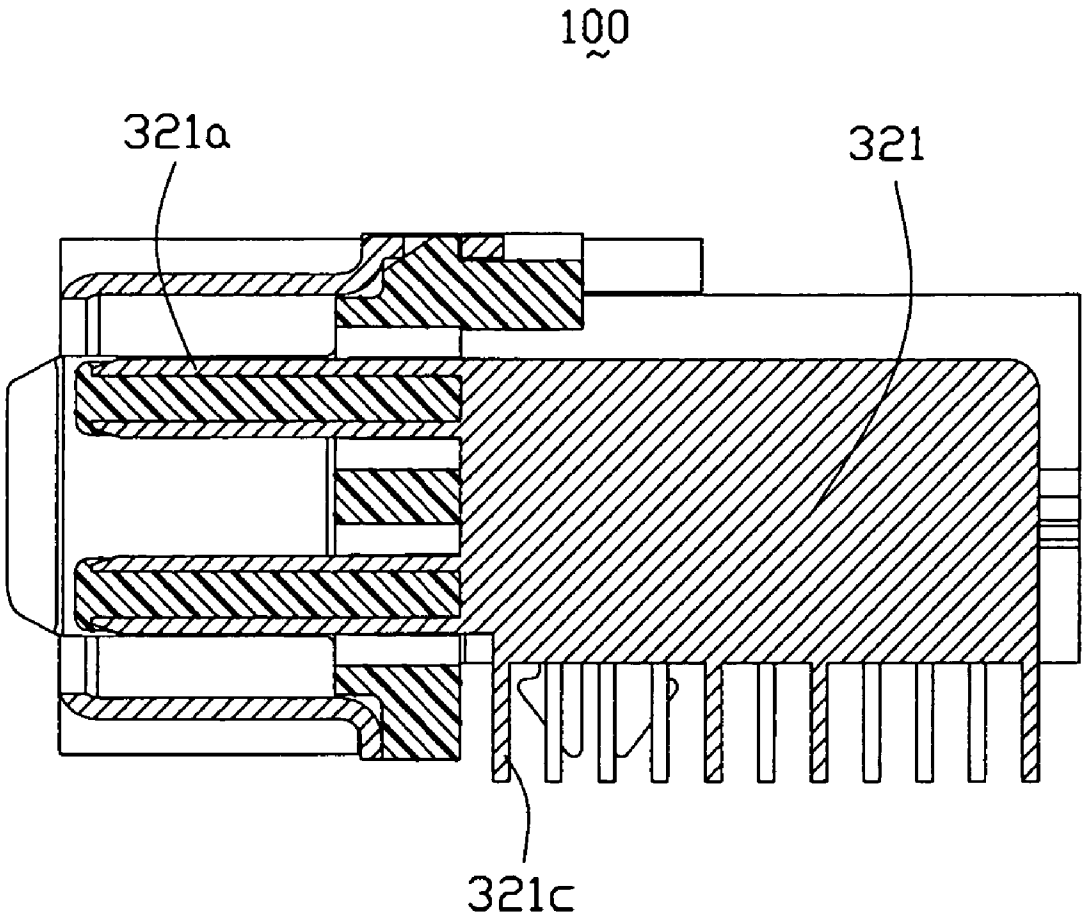
FIG. 7 is a cross-section view taken along 7—7 in FIG. 5.
Figure 8:
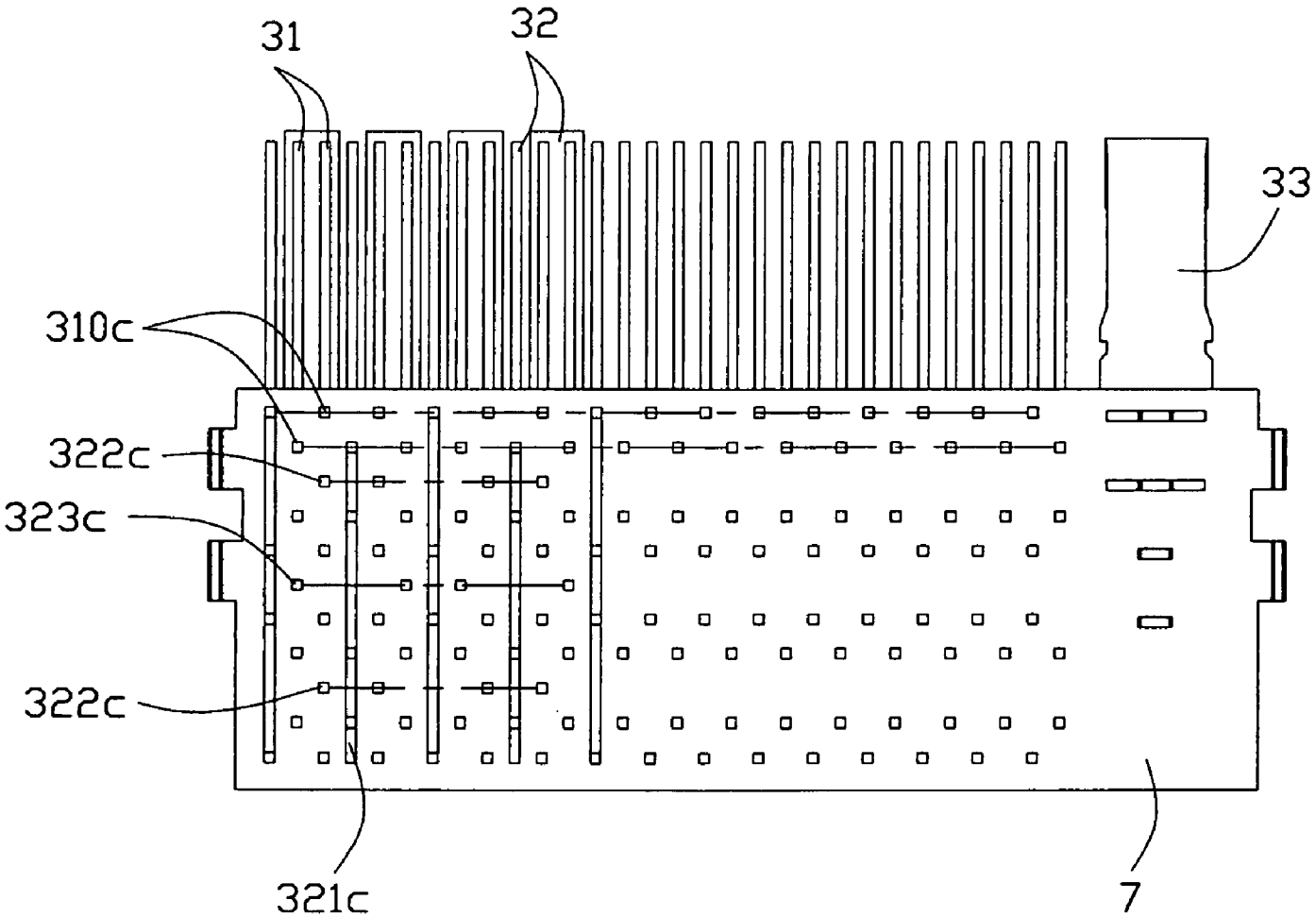
FIG. 8 is a bottom view of the connector of FIG. 1 clearly showing an arrangement of solder feet of the electrical elements in an aligning spacer.

In assembly within the housing 1, as best shown in FIG 6, horizontal parts of the second grounding plates 322 extend forwards to be embedded in the two tongues 11 respectively and horizontal parts of the third grounding plate 323 end at the front face of the base section 10 of the housing 1. Vertical parts 322*c* or 323*c* of both the second and third grounding plates 322, 323 are diminished to form solder feet to be soldered to the PCB as well as the solder feet 310*c* of the sign terminals 310. As best shown in FIG 7, the first grounding plate 321 is disposed in a vertical posture and has four contact portions 321*a* respectively attached to the four mating surfaces of the tongues 11 to align with the contact portions 310*a* of the signal terminals 310 in the rows. Each of the first grouding terminals 321 has four solder feet 321*c* vertically extending to be soldered to the PCB as well. The arrangement of all the solder feet 310*c*, 321*c*, 322*c*, 323*c* will be described hereafter.

Figure 2:
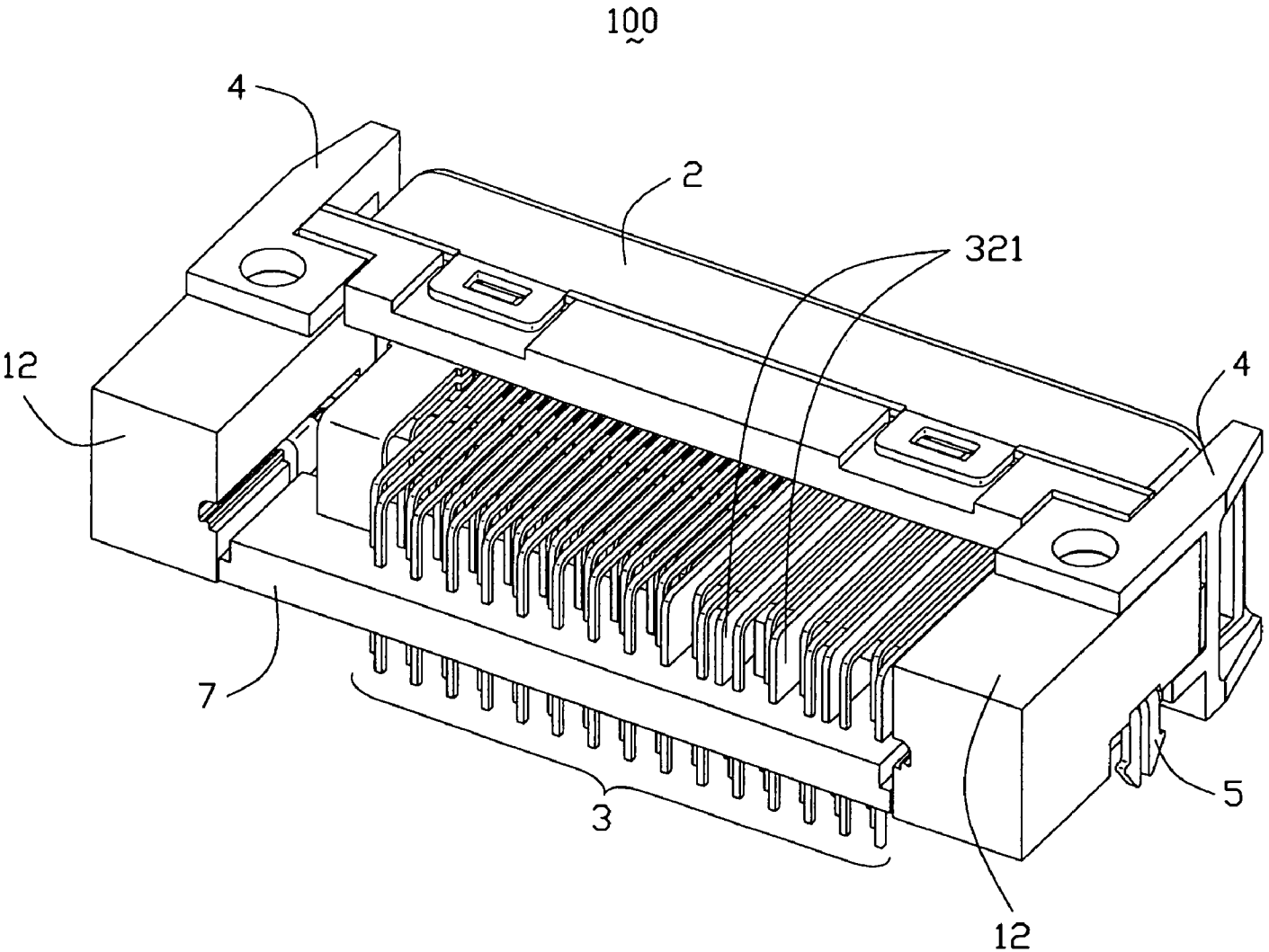
FIG. 2 is another assembled perspective view of the connector of FIG. 1 taken from another aspect.

Referring to FIGS. 2 and 10, there is a spacer 7 accommodated in the space between the two opposite mounting blocks 12 of the housing 1 to align the solder feet 310*c*, 321*c*, 322*c*, 323*c* and make them apart from each other with controlled space therebetween. The space between solder feet 310*c* of the two signal terminals 310 of each signal terminal pair 31 is maximized in such a pattern that one solder foot 310*c* is offset from the other both along the longitudinal direction and the width direction of the housing 1. Therefore each row of the signal terminal pairs 31 whose contact portions 310*a* are arranged to the same mating surface of the tongue 11 has its solder feet 310*c* divided into two rows as shown in FIG 10. The solder feet 322*c* of the second grounding plates 322 whose horizontal part embedded in the upper tongue 11 are arranged in a row, the solder feet 322*c* of the second grounding plates 322 whose horizontal part embedded in the lower tongue 11 are arranged in another row, and the solder feet 323*c* of the third grounding plate 323 arranged in a third row. These rows are intervened between corresponding rows of the solder feet 310*c* as shown in FIG 10.

Returning to FIG. 3, the power terminals 33 are arranged in a column placed at the right longitudinal end of the housing 1 adjacent to the signal terminal pairs 31 used to transmit signals of ordinary frequencies. Each power terminal 33 is also of a right-angled shape with a horizontal part thereof attached to the mating surface of tongues 11 and arranged with the contact portions 310*a* of the signal terminals 310 and a vertical part thereof to be soldered to the PCB.

Referring to FIGS. 1 and 3, the electrical connector 100 further includes a shell 2 assembled to the housing 1. The shell 2 comprises a plate portion 22 attached to the front face of the base section 10 and a rectangular frame portion 21 protruding forwards from the plate portion 21 for enclosing the tongues 11 to constitute a mating section for mating with the complement cable connector assembly. The plate section 22 is provided with a pair of lateral ears 23 at the longitudinal ends thereof and a pair of flanges 24 extending rearwardly along an upper face of the base section 10. Each flange 24 defines an aperture locking with a corresponding protrusion 113 formed on the upper face of the base section 10 for attaching the shell 2 to the housing 1.

The electrical connector 100 further includes a pair of locking members 4, and a pair of board locks 5. Each locking members 4 is provided with a mounting section 41 adapted for being mounted onto the mounting block 12 and a hook 40 extending forwardly from the mounting section 41 for latching with the complement cable connector assembly. The mounting section 41 is formed with upper and lower spaced mounting arms defining a space therebetween. In assembled state, each locking member 4 is assembled onto corresponding block 12 together with one of the board locks 5. A front end of the leg 12 and a horizontal mounting plate provided on the board lock 5 are both retained in the space between the upper and lower mounting arms of the locking member 4. Simultaneously, the ear 23 provided on the plate portion 22 of the shell 2 is tightly sandwiched between the locking member 4 and the base section 10, whereby the shell 2 is further secured on the housing 1. The board lock 5 is formed with a locking foot vertically extending beyond the housing 1 for being fitted into a hole defined in the PCB.

However, the disclosure is illustrative only, changes may be made in detail, especially in matter of shape, size, and arrangement of parts within the principles of the invention. For example, either the plurality of separated second grounding plates 322 or the plurality of separated third grounding plates 323 could be replaced by an integral elongated grounding plate embedded in the tongue 11.

Further, each of the first grounding plates 321 could have the two of its contact portions that attached to the same tongue 11 joined into a piece crossly embedded in the tongue 11.

What is claimed is:

1. An electrical connector comprising:

an insulative housing formed with at least a tongue;

signal terminal pairs loaded in the housing, each of the signal terminal pairs comprising a pair of adjacent signal terminals, the signal terminals having contact portions arranged on two opposing mating surfaces of each said at least a tongue;

a first grounding means having front portions arranged between adjacent signal terminal pairs on each said mating surface; and a second grounding means having front portions embedded in said at least a tongue between signal terminal pairs respectively arranged on the two opposing mating surfaces of each said at least a tongue.

2. The electrical connector as described in claim 1, wherein the signal terminal pairs on different said mating surfaces are arranged in columns by aligning to each other along a vertical direction perpendicular to said at least a tongue.

3. The electrical connector as described in claim 2, wherein the first grounding means includes a plurality of first grounding plates each disposed between adjacent said columns in an erect posture along the vertical direction and each formed with a column of said front portions.

4. The electrical connector as described in claim 2, wherein the second grounding means includes a plurality of second grounding plates each of a width corresponding to that of each said signal terminal pairs and each disposed in the column of said signal terminal pairs.

5. The electrical connector as described in claim 2, wherein the second grounding means is an elongated integrated plate.

6. The electrical connector as described in claim 1, wherein said at least a tongue includes two parallel tongues, and there is at least a third grounding means embedded in the housing and respectively disposed between every two of said at least two parallel tongues.

7. The electrical connector as described in claim 1, wherein each of said signal terminals comprises a tail portion adapted for being connected to a printed circuit board, and the tail portion is of a right-angled structure.

8. An electrical connector formed with a mating section adapted for mating with a mating connector comprising:

an insulative housing;

a plurality of signal terminals and ground terminals arranged in at least two terminal rows, each of the rows including at least a pair of adjacent said signal terminals and one of said ground terminals which are alternatively arranged along said each of the terminal rows; and a grounding row located between said at least two terminal rows; wherein said grounding row without any of said signal terminals thereof, includes at least one ground plate.

9. The electrical connector as described in claim 8, wherein each said signal terminal and each said ground terminal in one of said terminal rows is respectively opposed to a respective said signal terminal and a respective said ground terminal in another of said terminal rows.

10. The electrical connector as described in claim 9, wherein said at least a ground plate includes a plurality of ground plates each to insulate two said pair of adjacent signal terminals respectively in two adjacent terminal rows.

11. An electrical connector comprising:

an insulative housing defining a base with two tongues thereof, each of said tongues defining two opposite mating faces thereon;

a plurality of signal differential-pair contacts formed on each of said mating faces;

a first type grounding plate disposed in each of said tongues to isolate the adjacent differential-pair contacts from each other on opposite mating faces of the same tongue; and a second type grounding plate disposed between two opposite planes defined by said opposite tongues to isolate the adjacent differential-pair contacts from each other located on neighboring opposite mating faces of the different tongue, respectively.

* * * * *